US012246242B2

(12) United States Patent
Smith

(10) Patent No.: US 12,246,242 B2
(45) Date of Patent: Mar. 11, 2025

(54) EATING ASSISTANCE DEVICE

(71) Applicant: Leslie G. Smith, Mississauga (CA)

(72) Inventor: Leslie G. Smith, Mississauga (CA)

( * ) Notice: Subject to any disclaimer, the term of this patent is extended or adjusted under 35 U.S.C. 154(b) by 222 days.

(21) Appl. No.: 17/411,806

(22) Filed: Aug. 25, 2021

(65) Prior Publication Data

US 2023/0061351 A1 Mar. 2, 2023

(51) Int. Cl.
*A63B 71/08* (2006.01)
*A47G 21/00* (2006.01)

(52) U.S. Cl.
CPC ..... *A63B 71/085* (2013.01); *A47G 21/00* (2013.01)

(58) Field of Classification Search
CPC ..... A63B 71/085; A47G 21/00; A61C 17/08; A61C 17/10; A61C 5/00; A61C 5/88; A61C 5/90; A61C 1/08; A61B 1/00; A61B 1/07; A61B 1/247; A61B 17/02; A61B 1/24
USPC ..... 128/861
See application file for complete search history.

(56) References Cited

U.S. PATENT DOCUMENTS 375,773 A * 1/1888 Rockwell ..... B25G 1/105 30/340
2,436,040 A * 2/1948 Friedman ..... A61C 17/08 433/91
3,307,539 A * 3/1967 Petersen ..... A63B 71/085 D24/176
7,458,377 B2 12/2008 Falzon
2004/0259055 A1* 12/2004 Sherry ..... A61C 5/90 433/140
2019/0262110 A1 8/2019 Wakefield

FOREIGN PATENT DOCUMENTS

CH 257576 A 10/1948
WO 2019136276 A1 7/2019

* cited by examiner

*Primary Examiner* — Alireza Nia
*Assistant Examiner* — Daniel A Miller
(74) *Attorney, Agent, or Firm* — Brooks Kushman P.C.

(57) ABSTRACT

An eating assistance device includes a curved plate and a handle. The curved plate is sized and configured to be disposed within an oral cavity of a mouth between a cheek and adjacent teeth. The curved plate is sized and configured to follow an exterior contour of the adjacent teeth along a lateral side of the mouth. The curved plate is sized and configured to span a gap between top and bottom teeth of the adjacent teeth when a jaw within the mouth is opened to retain food items within the oral cavity. The curved plate has top and bottom edges that are substantially parallel. The handle extends from the mouth plate and is disposed on an exterior of the mouth when the curved plate is disposed within the oral cavity.

28 Claims, 5 Drawing Sheets

EATING ASSISTANCE DEVICE

TECHNICAL FIELD

The present disclosure relates to an oral device that is configured to assist an individual during food consumption.

BACKGROUND

Oral devices and tools are often utilized during oral and dental procedures. Oral devices are also often utilized during sporting events that may require protection for the mouth and teeth.

SUMMARY

An eating assistance device includes a mouth plate, a user handle, and a linking arm. The mouth plate is sized and configured to be disposed within a vestibule of an oral cavity along a lateral side of a mouth such that a cheek and adjacent teeth are respectively disposed on opposing sides of the mouth plate. The mouth plate is sized and configured to span a gap between top and bottom teeth of the adjacent teeth when a jaw within the mouth is opened to retain food items within the oral cavity. The mouth plate is sized and configured to not span upper and lower ends of the vestibule when the jaw is closed. The user handle is connected to the mouth plate and is configured to be disposed external to the oral cavity when the mouth plate is disposed within the vestibule. The linking arm secures the mouth plate to the user handle and orients the user handle such that the user handle extends outward from the mouth when the mouth plate is disposed within the vestibule. The linking arm is sized and configured to extend from the mouth plate, through an opening to the oral cavity, and to the user handle when the mouth plate is disposed within the vestibule.

An eating assistance device includes a curved plate and a handle. The curved plate is sized and configured to be disposed within an oral cavity of a mouth between a cheek and adjacent teeth. The curved plate is sized and configured to follow an exterior contour of the adjacent teeth along a lateral side of the mouth. The curved plate is sized and configured to span a gap between top and bottom teeth of the adjacent teeth when a jaw within the mouth is opened to retain food items within the oral cavity. The curved plate has top and bottom edges that are substantially parallel. The handle extends from the mouth plate and is disposed on an exterior of the mouth when the curved plate is disposed within the oral cavity.

An eating assistance device includes a mouth plate, a handle, and a linking plate. The mouth plate is configured to be disposed within an oral cavity of a mouth between a cheek and adjacent teeth. The mouth plate is sized and configured to follow an exterior contour of the adjacent teeth along a lateral side of the mouth. The mouth plate is sized and configured to span a gap between top and bottom teeth of the adjacent teeth when a jaw within the mouth is opened to retain food items within the oral cavity. The mouth plate is sized and configured to not span upper and lower ends of the oral cavity when the jaw is closed. The handle extends from the mouth plate and is disposed on an exterior of the mouth when the mouth plate is disposed within the oral cavity. The linking plate connects the mouth plate to the handle. The linking plate is sized and configured to extend from an exterior of the oral cavity, through an opening to the oral cavity, and into the oral cavity when the mouth plate is disposed within the oral cavity. The linking plate is substantially flat and is sized such that the opening to the oral cavity may be closed over the linking plate.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

A person with unilateral facial paralysis (typically Bell's Palsy) may face difficulty when eating. More specifically, it may be difficult to avoid biting the cheek and lip when such an individual chews food. It may also be difficult to retain food and liquids within the mouth when such an individual lacks the necessary muscle tone or the ability to control muscles on one side of the face while chewing food, which often occurs when an individual has unilateral facial paralysis. The present disclosure provides a device that helps to retain food and liquids within the mouth. The device also may act as a cheek and lip guard to prevent biting the cheek and lip while an individual is chewing food.

Figure 1:
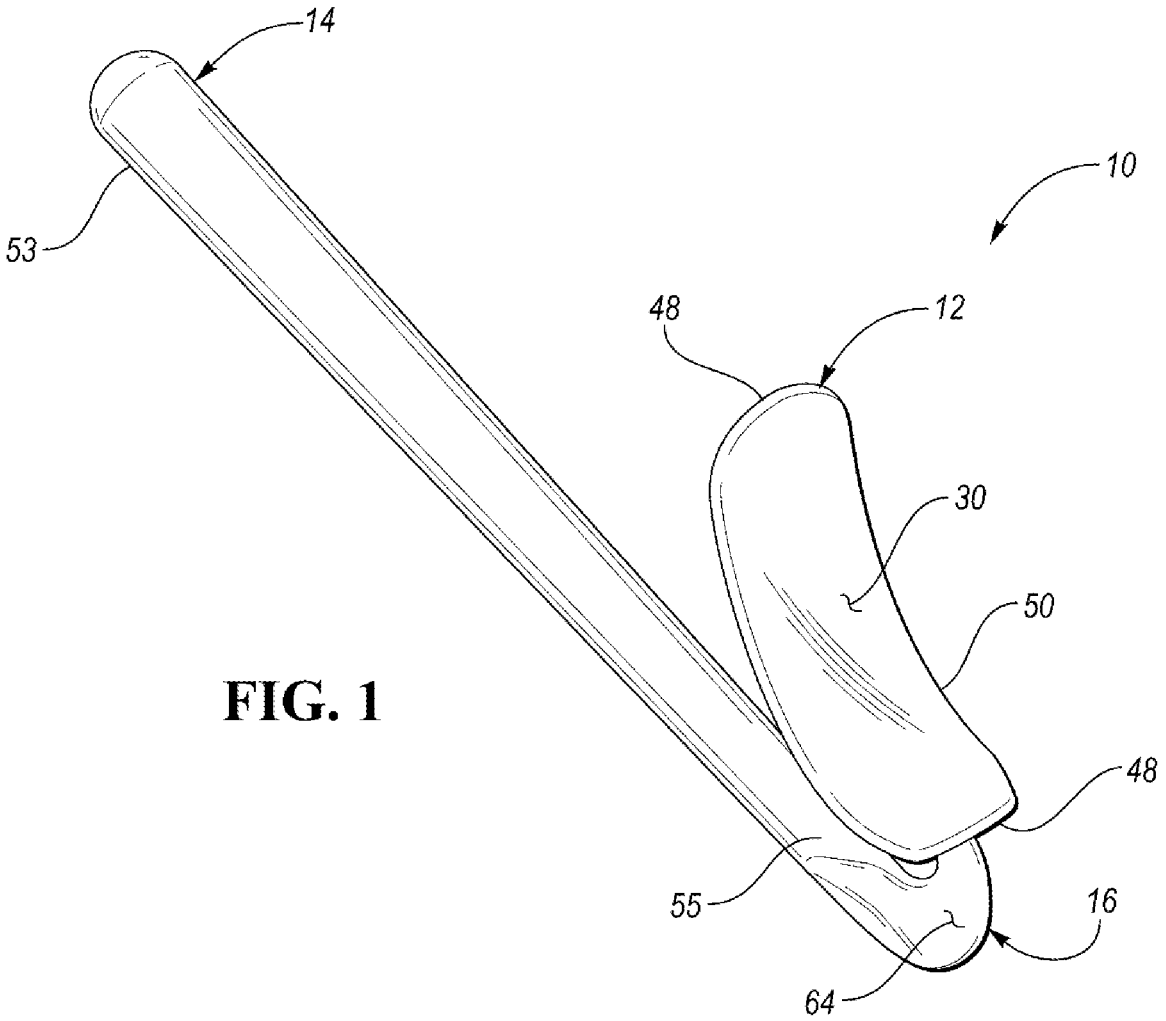
FIG. 1 is an isometric view of an eating assistance device.
Figure 2:
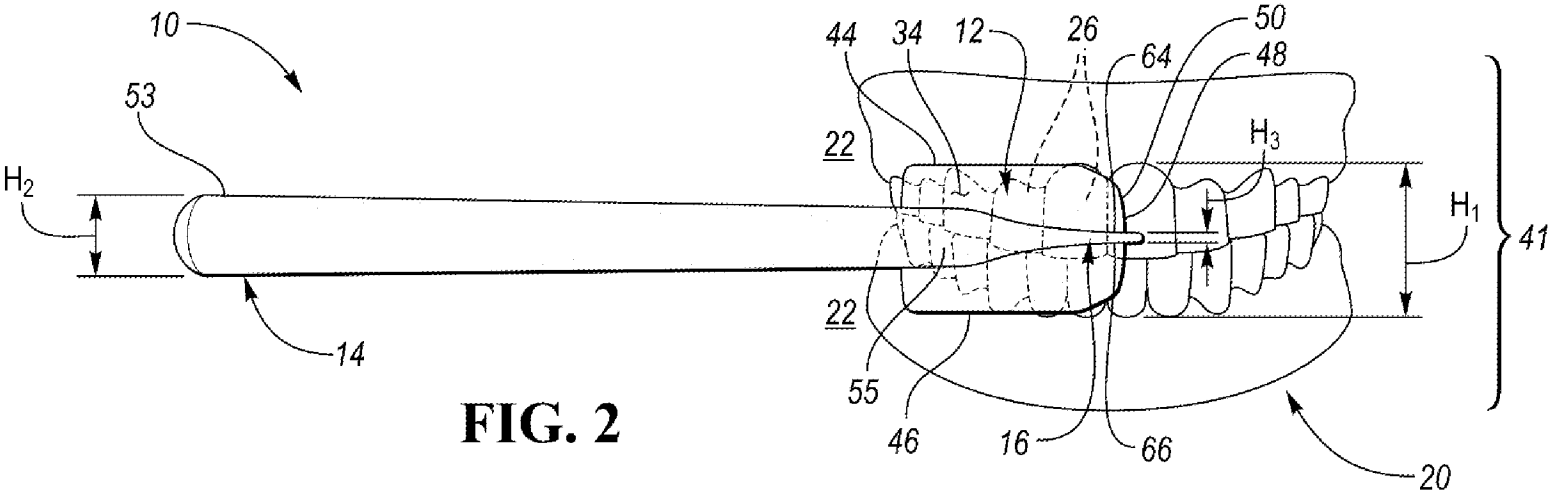
FIG. 2 is front view of the eating assistance device relative to an interior of the mouth while the jaw is closed.
Figure 3:
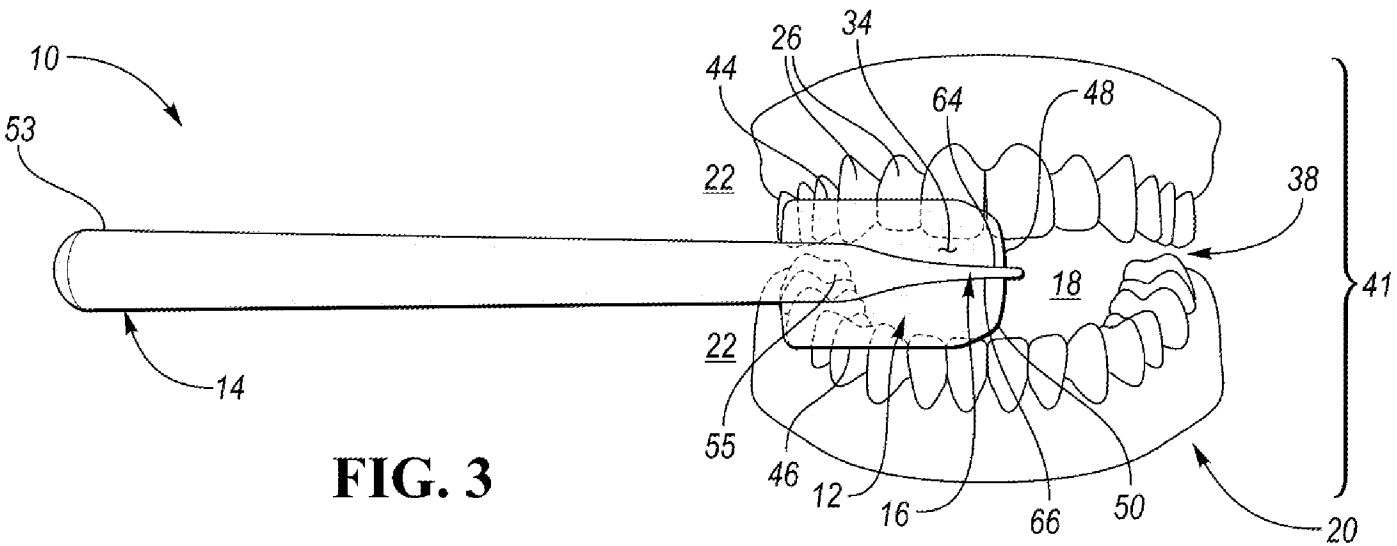
FIG. 3 is front view of the eating assistance device relative to the interior of the mouth while the jaw is open.
Figure 4:
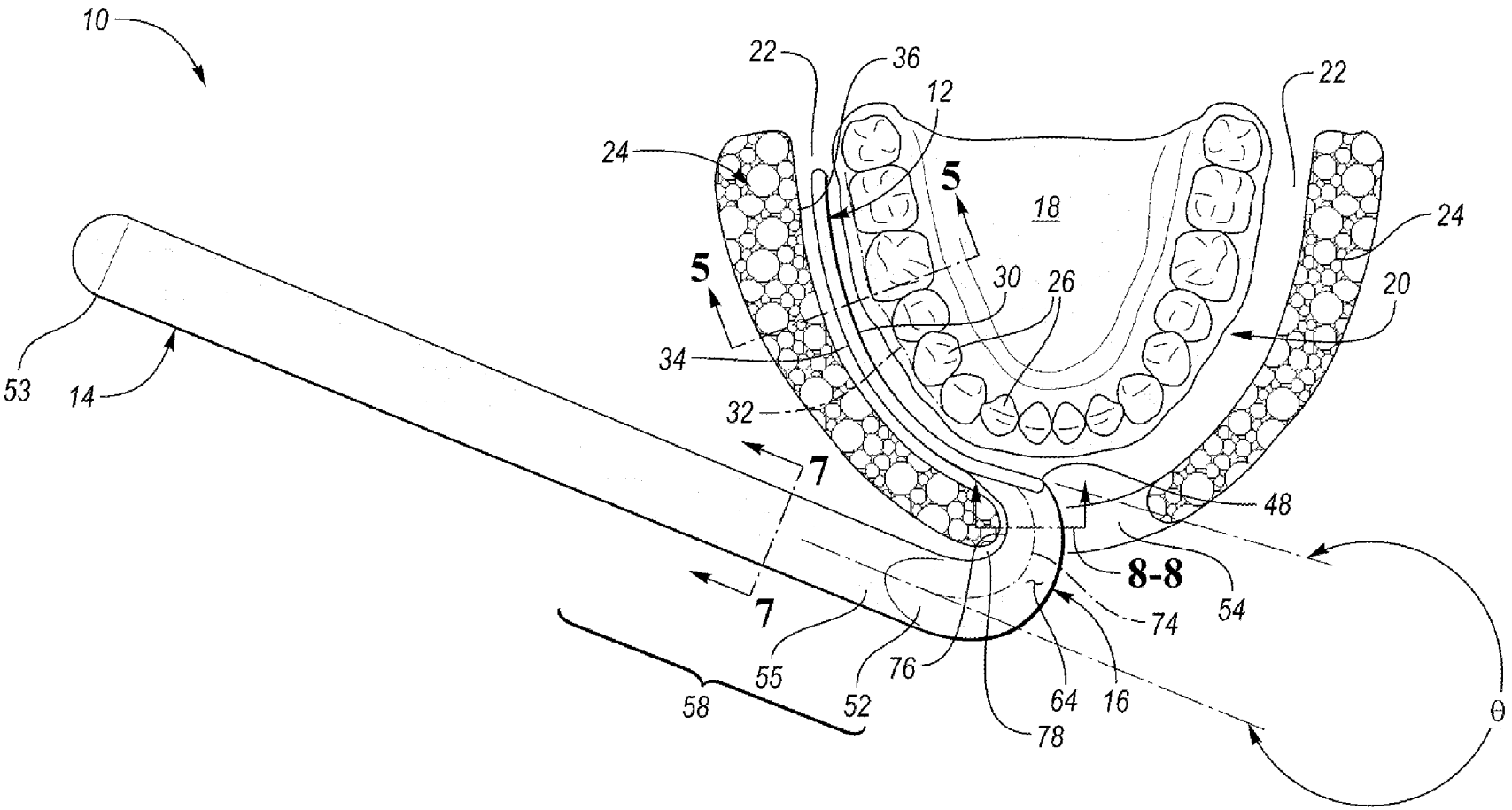
FIG. 4 is top view of the eating assistance device relative to a lower half of the mouth.
Figure 5:
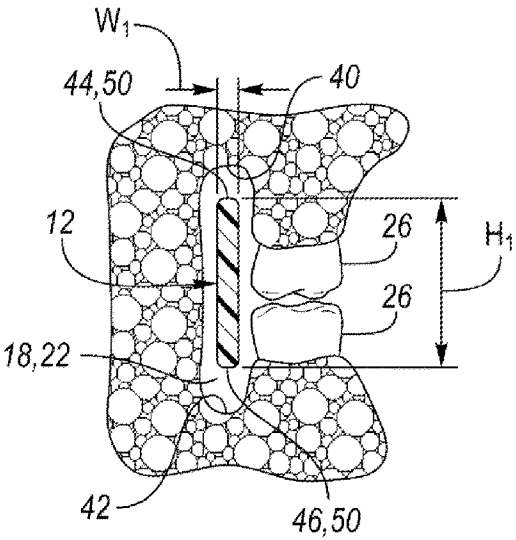
FIG. 5 is a cross-sectional view taken along line 5-5 in FIG. 4.
Figure 6:
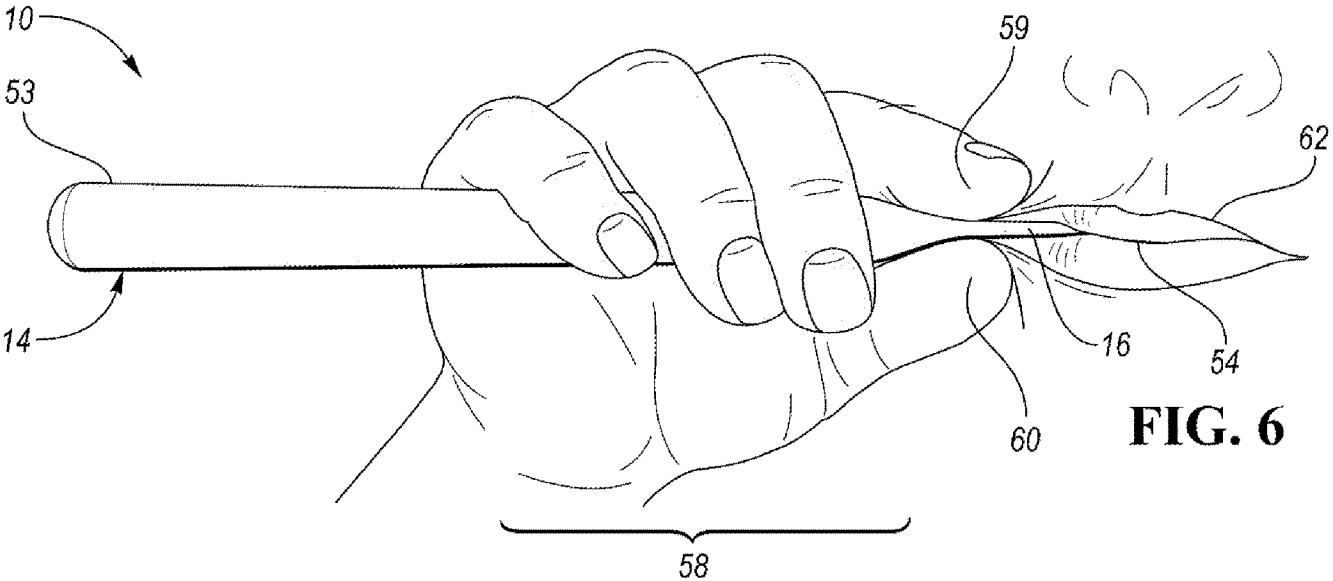
FIG. 6 is front view of the eating assistance device relative to an exterior of the mouth while the mouth is closed.
Figure 7:
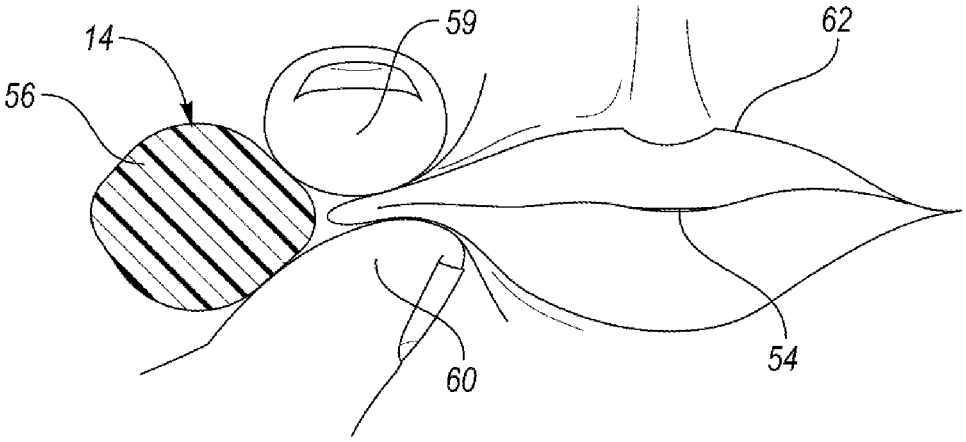
FIG. 7 a cross-sectional view taken along line 7-7 in FIG. 4.
Figure 8:
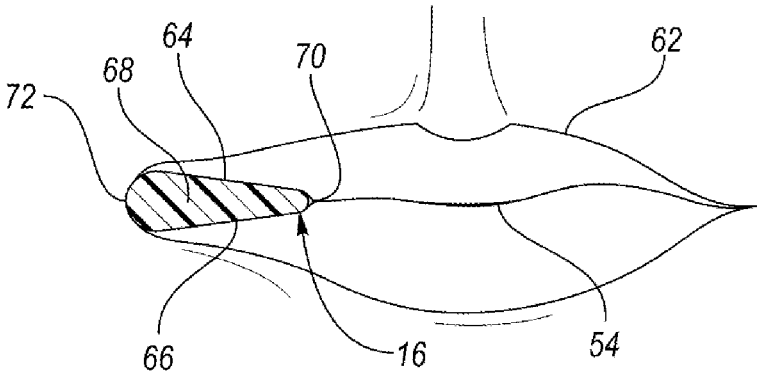
FIG. 8 a cross-sectional view taken along line 8-8 in FIG. 4.

Referring to FIG. 1, a food retention tool or an eating assistance device 10 is illustrated. The eating assistance device 10 includes a mouth plate 12, a user handle 14, and a linking arm 16. The mouth plate 12 may also be referred to as the curved plate. The user handle 14 may also be referred to as the handle. The linking arm 16 may also be referred to as the link, linking plate, or lip plate.

Referring to FIGS. 1-5, the mouth plate 12 is illustrated in further detail. The mouth plate 12 is sized and configured to be disposed within an oral cavity 18 of a mouth 20. More specifically, the mouth plate 12 is sized and configured to be disposed with a vestibule 22 of the oral cavity 18 along a lateral side of a mouth 20 such that a cheek 24 and adjacent teeth 26 are respectively disposed on opposing sides of the mouth plate 12. The vestibule 22 is the space along the outside of the teeth 26 of the mouth 20 that is between the teeth 26 and the cheeks 24 and that is between the teeth 26 and the lips. An interior surface or side 30 of the mouth plate 12 is configured to follow an exterior contour 32 of the adjacent teeth 26 along a lateral side of the mouth 20 within the vestibule 22. An exterior surface or side 34 of the mouth plate 12 is configured to follow an interior contour 36 of the cheek 24 along a lateral side of the mouth 20 within the vestibule 22. Stated in other terms, it may be said that the mouth plate 12 is curved to follow the contour of the vestibule 22 or the outside of a mandibular arch along a lateral side of the mouth 20. The mouth plate 12 may have a parabolic or any other suitable curved shape to adhere to the contour of the vestibule 22 along a lateral side of the mouth 20. It is noted that the top teeth are not illustrated in FIG. 4. However, it should be understood that the interior side 30 of the mouth plate 12 follows the exterior contour 32 of the adjacent teeth 26 and the exterior side 34 of the mouth plate 12 follows the interior contour 36 of the cheek 24 along the top teeth as well as along the bottom teeth.

The mouth plate 12 is also sized and configured to span a space or gap 38 between top and bottom teeth of the adjacent teeth 26 when the jaw 41 is opened to retain food items within the oral cavity 18. The mouth plate 12 is also sized and configured to not span an upper end 40 and a lower end 42 of the vestibule 22 when the jaw 41 is closed. The space or gap 38 between the top and bottom teeth of the adjacent teeth 26 is also closed when the jaw 41 is closed. The mouth plate 12 may be shaped and sized to fit into the vestibule 22 when the jaw 41 is both opened and closed and to span the gap 38 between top and bottom teeth of the adjacent teeth 26 when the jaw 41 is opened in order to retain food items within the oral cavity 18. For example (i) the mouth plate 12 may have a width, $W_1$, that is sufficiently thin so that the mouth plate 12 may be disposed within the vestibule 22 between the cheek 24 and the adjacent teeth 26, (ii) may have a height, $H_1$, that is sufficiently tall to span the gap 38 between top and bottom teeth of the adjacent teeth 26 when the jaw 41 is opened, and (iii) may have a top edge 44 and a bottom edge 46 that are substantially parallel so as to not come into contact with the upper end 40 and the lower end 42 of the vestibule 22, respectively, when the jaw 41 is closed. Substantially parallel may refer to any incremental value that is between exactly parallel and 15° from exactly parallel.

The mouth plate 12 may also span an entire half of the teeth 26 from the front teeth (e.g., the front incisors) to the back teeth (e.g., the back molars). Although illustrated along one side of the mouth, the mouth plate 12 may be disposed along either the left or right side of the mouth 20. More specifically, the eating assistance device 10 may be symmetrical along a longitudinal plane or horizontal plane to facilitate ease of use on either side of the mouth 20.

Opposing ends 48 of the mouth plate 12 taper from the top edge 44 and the bottom edge 46. Stated in other terms, the opposing ends 48 of the mouth plate 12 are rounded or have fillets to eliminate sharp corners. An outer peripheral edge 50 of the mouth plate 12 is also rounded or has fillets to eliminate sharp corners. The outer peripheral edge 50 may include the top edge 44, the bottom edge 46, and the opposing ends 48 of the mouth plate 12. The rounded ends and edges of the mouth plate 12 are included for safety purposes. More specifically, by including the rounded ends and edges, any sharp corners or edges that may cause lacerations are eliminated. The rounded ends and edges also help to facilitate inserting and removing the mouth plate 12 from the vestibule 22.

Referring now to FIGS. 1-4 and 6-7, the user handle 14 is illustrated in further detail. The user handle 14 may be utilized while inserting the mouth plate 12 into or extracting the mouth plate 12 from the vestibule 22. More specifically, a user's hand may grab onto the user handle 14 to position the mouth plate 12 within the vestibule 22 and may hold onto to the user handle 14 to maintain the position of the mouth plate 12 within the vestibule 22. The user handle 14 is connected to the mouth plate 12. The user handle 14 extends from the mouth plate 12 and is configured to be disposed external to the oral cavity 18 and the vestibule 22 when the mouth plate 12 is disposed within the vestibule 22. More specifically, the user handle 14 is configured to be disposed on the exterior of the entire mouth 20 when the mouth plate 12 is disposed within the vestibule 22. The user handle 14 extends outward from the opening 54 to the oral cavity 18 (i.e., the opening to the mouth 20 defined by the lips). The user handle 14 may extend along the outside surface of the cheek 24 when the when the mouth plate 12 is disposed within the vestibule 22. The user handle 14 may partially extend laterally and rearward relative to the mouth 20 or to the user's face.

The user handle 14 may more specifically be connected to the mouth plate 12 via the linking arm 16. The linking arm 16 may secure an end 52 of the user handle 14 to one of the ends 48 of the mouth plate 12. The linking arm 16 may also orient the user handle 14 at an angle, θ, relative to the end 48 of the mouth plate 12 that ranges between 135° and 225°. The user handle 14 may also be thicker along a distal end 53 relative to a proximal end 55 that is adjacent to the mouth plate 12 and the linking arm 12. Stated in other terms, the user handle 14 may taper in a direction that extends from the distal end 53 relative to a proximal end 55.

The user handle 14 may also include has a tear-drop shaped cross-section 56 that tapers laterally toward the mouth plate 12. The tear-drop shaped cross-section 56 may more specifically be defined along a section 58 of the user handle 14 that is proximal to the mouth plate 12 and linking arm 16. The tear-drop shaped cross-section 56 provides additional space between the user handle 14 and user's face or cheek along top and bottom sides of the user handle 14 so that a user's finger 59 (e.g., index finger) and thumb 60 may be utilized to pinch the cheek 24 and/or lips 62 (See FIGS. 6 and 7) along one side of the opening 54 to the oral cavity 18. Please note that the cross-section cut line for FIG. 7 in FIG. 4 (i.e., line 7-7) only pertains to the tear-drop shaped cross-section 56. However, the lips 62, finger 59, and thumb 60 have been added to FIG. 7 for illustrative purposes. This helps to retain the mouth plate 12 in the vestibule 22 and to ensure the opening 54 to the oral cavity 18 along one side of the mouth 20 remains closed, which is desirable particularly when a user who has paralysis on one side of their face is chewing food. Pinching the cheek 24 and/or lips 62 along one side of the opening 54 to the oral cavity 18 prevents food from falling out of the oral cavity 18 and also prevents the user from biting their own cheek, which is can occur without notice when a user has paralysis on one side of their face. Therefore, the eating assistance device 10 may also function as a cheek guard.

Referring now to FIGS. 1-4, 6, and 8, the linking arm 16 is illustrated in Further detail. The linking arm 16 secures the mouth plate 12 to the user handle 14. The linking arm 16 also orients the user handle 14 such that the user handle 14 extends outward from the mouth 20 when the mouth plate 12 is disposed within the vestibule 22. The linking arm 16 is sized and configured to extend from the mouth plate 12, through the opening 54 to the oral cavity 18, and to the user handle 14 when the mouth plate 12 is disposed within the vestibule 22. Stated in other terms and in the reverse, the linking arm 16 is sized and configured to extend from an exterior of the oral cavity 18, through the opening 54 to the oral cavity 18, and into the oral cavity 18 when the mouth plate 12 is disposed within the oral cavity 18, and more specifically when the mouth plate 12 is disposed the vestibule 22.

The linking arm 16 is substantially flat and is sized such that the opening 54 to the oral cavity 18 or the lips 62 may be closed over the linking arm 16. More specifically, an upper surface 64 and an opposing lower surface 66 of the liking arm 16 may each be substantially flat such that the opening 54 to the oral cavity 18 or the lips 62 may be closed over the linking arm 16. Substantially flat may refer to a flat surface that has no deviations from a perfectly flat plane or has deviations from the perfectly flat plane that are less than a tolerance. For example, the upper surface 64 and the lower surface 66 may have an allowable tolerance of 2 millimeters (mm) or less, 1 mm or less, or 0.5 mm or less, 0.25 mm or less, etc. from corresponding perfectly flat planes.

The linking arm 16 has a cross-sectional shape 68 that tapers in a direction that extends from an end toward a center of the opening 54 to the oral cavity 18 or toward a center of the lips 62 when the mouth plate 12 is disposed within the oral cavity 18 and more specifically when the mouth plate 12 is disposed within the vestibule 22. More specifically, the linking arm 16 (*i*) may be thinner along an external edge 70 that is positioned toward a center of the opening 54 to the oral cavity 18 (or toward a center of the lips 62) to allow the lips 62 to close or seal over the linking arm 16 to minimize the leakage of food and liquids from the oral cavity and (ii) may be thicker and rounded (or filleted) along an internal edge 72 that that is positioned in a corner of the opening 54 to oral cavity 18 (or a corner of the closed lips 62) for comfort purposes. Please note that the cross-section cut line for FIG. 8 in FIG. 4 (i.e., line 8-8) only pertains to the cross-sectional shape 68. However, the lips 62 have been added to FIG. 8 for illustrative purposes.

The mouth plate 12, user handle 14, and linking arm 16 have vertical dimensions or heights, $H_1$, $H_2$, and $H_3$ respectively, that extend in a direction from a top to a bottom of the mouth 20 when the mouth plate 12 is disposed within the oral cavity 18 and more specifically when the mouth plate 12 is disposed within the vestibule 22. The height of the linking arm, $H_3$, is smaller than the height of the mouth plate, $H_1$, and the height, $H_2$, of the user handle 14, and is sized such that the opening 54 to the oral cavity 18 or the lips 62 may be closed or sealed over the linking arm 16. The height, $H_2$, of the user handle 14 may also be smaller than the height of the mouth plate, $H_1$.

The linking arm 16 defines an arc 74 that orients the user handle 14 at the angle, θ, relative to the end 48 of the mouth plate 12. The curvature of an inner or internal edge 76 of the linking arm 16, as seen from above, may be greater than the thickness of the cheek 24, so that the user handle 14 will sit near the surface of the face when the eating assistance device 10 is being used. This allows a user's the fingers to both hold onto the user handle 14 and to hold the lips 62 shut against the upper surface 64 and the lower surface 66 of the linking arm 16 along one side of the mouth 20 in order retain food items within the oral cavity 18. Also, curvature of an inner or internal edge 76 of the linking arm 16, as seen from above, may be greater than the thickness of the cheek 24, so that the cheek 24 may comfortably rest within a slot 78 defined by the internal edge 76 of the linking arm 16. The slot 78 is configured to straddle the cheek 24 via the opening 54 to the oral cavity 18 when the mouth plate 12 is disposed within the vestibule 22.

The eating assistance device 10 may be made from any material but is preferably made from a material that will not damage the teeth 26 or soft tissue within the mouth 20. For example, the eating assistance device 10 may be made from a plastic material, such as a thermoplastic, thermoset plastic, or polymer. The material should be sufficiently rigid to maintain the shape of the eating assistance device 10 while being used but should be soft enough so as to not damage the teeth 26 or soft tissue within the mouth 20. However, the material is not limited to plastic materials and the eating assistance device 10 may alternatively be made from any metallic material, including but not limited to stainless steel.

It should be understood that the designations of first, second, third, fourth, etc. for any component, state, or condition described herein may be rearranged in the claims so that they are in chronological order with respect to the claims. Furthermore, it should be understood that elements labelled upper, lower, top, bottom, left, right, etc. may be adjusted if the eating assistance device 10 is utilized on the other side of the mouth 20 than illustrated.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. An eating assistance device comprising:

a curved plate sized and configured to (i) be disposed within an oral cavity of a mouth such that a cheek and an ipsilateral portion of lips are disposed on opposing sides of the curved plate relative to adjacent teeth, (ii) follow an exterior contour of the adjacent teeth along a lateral side of the mouth, and (iii) span a gap between top and bottom teeth of the adjacent teeth when a jaw within the mouth is opened to chew, in order to retain food items within the oral cavity, wherein (i) the curved plate includes a top edge, a bottom edge, and opposing side edges forming an outer periphery of the curved plate, (ii) the curved plate has first and second opposing surfaces each bound within the outer periphery, (iii) the first surface is concave in a direction extending between the opposing side edges, and (iv) the second surface is convex in the direction extending between the opposing side edges, and (v) the top and bottom edges are substantially parallel;

a handle extending (i) from the curved plate and (ii) disposed on an exterior of the mouth when the curved plate is disposed within the oral cavity-cavity; and a link (i) securing the curved plate to the handle, (ii) directly attached to the second surface of the curved plate, and (iii) positing the handle such that a proximal end of the handle is configured to sit in front of the lips on an ipsilateral side of the mouth, and a body of the handle is configured to extend outward from the proximal end of the handle when the curved plate is disposed within the oral cavity, and wherein the curved plate, handle, and link are each symmetrical along a common plane.

2. The eating assistance device of claim 1, wherein the link is sized and configured to extend (i) through an opening to the oral cavity and (ii) to the handle when curved plate is disposed within the oral cavity.

3. The eating assistance device of claim 2, wherein the curved plate, handle, and link have vertical dimensions extending in a direction from a top to a bottom of the mouth, and wherein the vertical dimension of the link is (i) smaller than the vertical dimensions of the curved plate and handle and (ii) sized such that the opening to the oral cavity may be closed over the link.

4. The eating assistance device of claim 3, wherein the link (i) extends along an arc and (ii) has upper and lower opposing substantially flat surfaces, wherein the substantially flat surfaces are configured such that (i) an upper lip is configured to rest on the upper substantially flat surface of the substantially flat surfaces of the link while the lips are held shut over the link and (ii) a lower lip is configured to rest on the lower substantially flat surface of the substantially flat surfaces of the link while the lips are held shut over the link, and wherein the first and second opposing substantially flat surfaces taper toward each in a direction extending radially outward along the arc.

5. The eating assistance device of claim 2, wherein the link secures an end of the handle to the curved plate and (ii) orients the handle at an angle relative to an end of the curved plate that ranges between 135° and 225°.

6. The eating assistance device of claim 1, wherein the link defines an arc, and wherein an internal edge of the link along the arc defines a slot configured to straddle the cheek via an opening to the oral cavity when the curved plate is disposed within the oral cavity.

7. The eating assistance device of claim 1, wherein the curved plate and the handle each extend from the link such that a space is defined between the curved plate and the handle, wherein the handle extends along a major axis from a proximal end adjacent to the link to a distal end, and wherein the link (i) defines an arc extending from the curved plate to the handle, (ii) defines a portion of the space between the curved plate and the handle, and (iii) has a cross-sectional shape that is defined as an intersection of the link and a vertical plane that is parallel to the major axis of the handle and passing through a mid-point of the arc of the link, and (iv) the cross-sectional shape tapers in a direction that extends radially outward along the arc and away from the space defined between the curved plate and the handle such that the cross-sectional shape is configured to taper from a first point at a lateral end of an opening to the oral cavity toward a second point that is closer to a center of the opening to the oral cavity relative to the first point when the curved plate is disposed within the oral cavity.

8. The eating assistance device of claim 1, wherein opposing ends of the curved plate taper from the top and bottom edges.

9. The eating assistance device of claim 1, wherein (i) the curved plate and the handle each extend from the link such that a space is defined between the curved plate and the handle, (ii) the handle extends along a major axis from a proximal end adjacent to the link to a distal end (iii) the handle has a tear-drop shaped cross-section on an opposing side of the space relative to the curved plate, (iv) the tear-dropped shaped cross-section is defined within a plane that is orthogonal to the major axis of the handle, and (v) the tear-drop shaped cross-section tapers along the plane from upper and lower apexes of the user handle, laterally toward the curved plate along a width of the handle, and toward the space defined between the curved plate and the handle such that spaces are configured to be defined (i) between the handle and the cheek and (ii) along a top and a bottom of the handle to receive a finger and a thumb for engaging the lips.

10. The eating assistance device of claim 1, wherein a cross-section of the curved plate defines a surface that (i) is configured to face the teeth when the curved plate is disposed within the oral cavity between the cheek and the adjacent teeth and (ii) is flat along a vertical direction.

11. An eating assistance device comprising:

a mouth plate sized and configured to (i) be disposed within a vestibule of an oral cavity along a lateral side of a mouth such that a cheek and an ipsilateral portion of lips are disposed on opposing sides of the mouth plate relative to adjacent teeth, (ii) span a gap between top and bottom teeth of the adjacent teeth when a jaw within the mouth is opened to chew, in order to retain food items within the oral cavity, and (iii) not span upper and lower ends of the vestibule when the jaw is closed, wherein (i) the mouth plate includes a top edge, a lower edge, and opposing side edges forming an outer periphery of the mouth plate, (ii) the mouth plate has first and second opposing surfaces each bound within the outer periphery, (iii) the first surface is concave in a direction extending between the opposing side edges, and (iv) the second surface is convex in the direction extending between the opposing side edges;

a user handle (i) connected to the mouth plate and (ii) configured to be disposed external to the oral cavity when the mouth plate is disposed within the vestibule; and a linking arm (i) securing the mouth plate to the user handle, (ii) directly attached to the second surface of the mouth plate, and (iii) orienting the user handle such that the user handle extends outward from the mouth when the mouth plate is disposed within the vestibule, wherein the linking arm is sized and configured to extend (i) from the mouth plate, (ii) through an opening to the oral cavity, and (iii) to the user handle when the mouth plate is disposed within the vestibule, and wherein the mouth plate, user handle, and linking arm are each symmetrical along a common plane.

12. The eating assistance device of claim 11, wherein top and bottom edges of the mouth plate are substantially parallel.

13. The eating assistance device of claim 12, wherein opposing ends of the mouth plate taper from the top and bottom edges.

14. The eating assistance device of claim 11, wherein the mouth plate, user handle, and linking arm have vertical dimensions extending in a direction from a top to a bottom of the mouth, and wherein the vertical dimension of the linking arm is (i) smaller than the vertical dimensions of the mouth plate and user handle and (ii) sized such that the opening to the oral cavity may be closed over the linking arm.

15. The eating assistance device of claim 14, wherein the linking arm (i) extends along an arc and (ii) has upper and lower opposing substantially flat surfaces, wherein the substantially flat surfaces are configured such that (i) an upper lip is configured to rest on the upper substantially flat surface of the substantially flat surfaces of the linking arm when the lips are held shut over the linking arm and (ii) a lower lip is configured to rest on the lower substantially flat surface of the substantially flat surfaces of the linking arm when the lips are held shut over the linking arm, and wherein the first and second opposing substantially flat surfaces taper toward each other in a direction extending radially outward along the arc.

16. The eating assistance device of claim 11, wherein the linking arm further positions the user handle such that a proximal end of the user handle is configured to sit in front of the lips on an ipsilateral side of the mouth, and a body of the user handle is configured to extend rearward from the proximal end of the user handle when the mouth plate is disposed within the vestibule.

17. The eating assistance device of claim 11, wherein the mouth plate is curved to follow a contour of the vestibule along the lateral side of the mouth.

18. The eating assistance device of claim 11, wherein the linking arm (i) secures an end of the user handle to an end of the mouth plate and (ii) orients the user handle at an angle relative to the end of the mouth plate that ranges between 135° and 225°.

19. The eating assistance device of claim 11, wherein (i) the mouth plate and the user handle each extend from the linking arm such that a space is defined between the mouth plate and the user handle, (ii) the user handle extends along a major axis from a proximal end adjacent to the linking arm to a distal end (iii) the user handle has a tear-drop shaped cross-section on an opposing side of the space relative to the mouth plate, (iv) the tear-dropped shaped cross-section is defined within a plane that is orthogonal to the major axis of the user handle, and (v) the tear-drop shaped cross-section tapers along the plane from upper and lower apexes of the user handle, laterally toward the mouth plate along a width of the user handle, and toward the space defined between the mouth plate and the user handle such that spaces are configured to be defined (i) between the user handle and the cheek and (ii) along a top and a bottom of the user handle to receive a finger and a thumb for engaging the lips.

20. The eating assistance device of claim 11, wherein the linking arm defines an arc, and wherein an internal edge of the linking arm along the arc defines a slot configured to straddle the cheek via the opening to the oral cavity when the mouth plate is disposed within the vestibule.

21. The eating assistance device of claim 11, wherein the mouth plate and the user handle each extend from the linking arm such that a space is defined between the mouth plate and the user handle, wherein the user handle extends along a major axis from a proximal end adjacent to the linking arm to a distal end, and wherein the linking arm (i) defines an arc extending from the mouth plate to the user handle, (ii) defines a portion of the space between the mouth plate and the user handle, (iii) has a cross-sectional shape that is defined as an intersection of the linking arm and a vertical plane that is parallel to the major axis of the user handle and passing through a mid-point of the arc of the linking arm, and (iv) the cross-sectional shape tapers in a direction that extends radially outward along the arc and away from the space defined between the mouth plate and the user handle such that the cross-sectional shape is configured to taper from a first point at a lateral end of the opening to the oral cavity toward a second point that is closer to a center of the opening to the oral cavity relative to the first point when the mouth plate is disposed within the vestibule.

22. The eating assistance device of claim 11, wherein a cross-section of the mouth plate defines a surface that (i) is configured to face the teeth when the mouth plate is disposed within the vestibule and (ii) is flat along a vertical direction.

23. An eating assistance device comprising:

a mouth plate sized and configured to (i) be disposed within an oral cavity of a mouth such that a cheek and an ipsilateral portion of lips are disposed on opposing sides of the curved plate relative to adjacent teeth, (ii) follow an exterior contour of the adjacent teeth along a lateral side of the mouth, (iii) span a gap between top and bottom teeth of the adjacent teeth when a jaw within the mouth is opened to chew, in order to retain food items within the oral cavity, and (iv) not span upper and lower ends of the oral cavity when the jaw is closed, wherein (i) the mouth plate includes a top edge, a lower edge, and opposing side edges forming an outer periphery of the mouth plate, (ii) the mouth plate has first and second opposing surfaces each bound within the outer periphery, (iii) the first surface is concave in a direction extending between the opposing side edges, and (iv) the second surface is convex in the direction extending between the opposing side edges;

a handle extending (i) from the mouth plate and (ii) disposed on an exterior of the mouth when the mouth plate is disposed within the oral cavity; and a linking plate (i) connecting the mouth plate to the handle, (ii) directly attached to the second surface of the mouth plate, and (iii) sized and configured to extend from an exterior of the oral cavity, through an opening to the oral cavity, and into the oral cavity when the mouth plate is disposed within the oral cavity, wherein the linking plate is substantially flat in a horizontal plane and sized such that the opening to the oral cavity may be closed over the linking plate, and wherein the mouth plate, handle, and linking plate are each symmetrical along a common plane.

24. The eating assistance device of claim 23, wherein (i) the mouth plate and the handle each extend from the linking plate such that a space is defined between the mouth plate and the handle, (ii) the handle extends along a major axis from a proximal end adjacent to the linking plate to a distal end (iii) the handle has a tear-drop shaped cross-section on an opposing side of the space relative to the mouth plate, (iv) the tear-dropped shaped cross-section is defined within a plane that is orthogonal to the major axis of the handle, and (v) the tear-drop shaped cross-section tapers along the plane from upper and lower apexes of the handle, laterally toward the mouth plate along a width of the handle, and toward the space defined between the curved plate and the handle such that spaces are configured to be defined (i) between the handle and the cheek and (ii) along a top and a bottom of the handle to receive a finger and a thumb for engaging the lips.

25. The eating assistance device of claim 23, wherein top and bottom edges of the mouth plate are substantially parallel.

26. The eating assistance device of claim 23, wherein the linking plate defines an arc, and wherein an internal edge of the linking plate along the arc defines a slot configured to straddle the cheek via the opening to the oral cavity when the mouth plate is disposed within the oral cavity.

27. The eating assistance device of claim 23, wherein the mouth plate and the handle each extend from the linking plate such that a space is defined between the mouth plate and the handle, wherein the handle extends along a major axis from a proximal end adjacent to the linking plate to a distal end, and wherein the linking plate (i) defines an arc extending from the mouth plate to the handle, (ii) defines a portion of the space between the mouth plate and the handle, and (iii) has a cross-sectional shape that is defined as an intersection of the linking plate and a vertical plane that is parallel to the major axis of the handle and passing through a mid-point of the arc of the linking plate, and (iv) the cross-sectional shape tapers in a direction that extends radially outward along the arc and away from the space defined between the mouth plate and the handle such that the cross-sectional shape is configured to taper from a first point at a lateral end of the opening to the oral cavity toward a second point that is closer to a center of the opening to the oral cavity relative to the first point when the mouth plate is disposed within the oral cavity.

28. The eating assistance device of claim 23, wherein a cross-section of the mouth plate defines a surface that (i) is configured to face the teeth when the mouth plate is disposed within the oral cavity between the cheek and the adjacent teeth and (ii) is flat along a vertical direction.

* * * * *